US006688219B2

(12) United States Patent
Klemm

(10) Patent No.: US 6,688,219 B2
(45) Date of Patent: Feb. 10, 2004

(54) DEVICE FOR PRINTING PRINTED SHEETS ACCORDING TO THE SCREEN PRINTING METHOD

(76) Inventor: Gerhard Klemm, Unter der Howe 38, 33813 Oerlinghausen (DE)

( * ) Notice: Subject to any disclaimer, the term of this patent is extended or adjusted under 35 U.S.C. 154(b) by 0 days.

(21) Appl. No.: 09/800,304

(22) Filed: Mar. 2, 2001

(65) Prior Publication Data

US 2001/0045164 A1 Nov. 29, 2001

(30) Foreign Application Priority Data

Mar. 3, 2000 (DE) ..... 100 10 107

(51) Int. Cl.[7] ..... B05C 17/06
(52) U.S. Cl. ..... 101/126; 101/118; 101/232
(58) Field of Search ..... 101/123, 126, 101/117, 118, 232; 400/624, 645

(56) References Cited

U.S. PATENT DOCUMENTS 3,719,141 A * 3/1973 Jaffa et al. ..... 101/126
4,459,093 A * 7/1984 Asano ..... 264/148
5,324,014 A * 6/1994 Honegger et al. ..... 270/52.18
5,823,526 A * 10/1998 Voge et al. ..... 198/839

* cited by examiner

*Primary Examiner*—Ren Yan
(74) *Attorney, Agent, or Firm*—McGlew and Tuttle, P.C.

(57) ABSTRACT

A device for printing printed sheets (1) according to the screen printing method has a printing table (10) and a screen mechanism (9) arranged above it, with a screen frame (8) and a conveying device (7) for moving the printed sheets (1) before, during and after the printing. The conveying device has, when viewed in the conveying direction, at least one clamping device (7) for clamping the lateral edge area of the printed sheets (7). The clamping device is arranged on the side of the printed sheets (1) and is displaceable in the conveying direction.

15 Claims, 4 Drawing Sheets

DEVICE FOR PRINTING PRINTED SHEETS ACCORDING TO THE SCREEN PRINTING METHOD

FIELD OF THE INVENTION

The present invention pertains to a device for printing printed sheets according to the screen printing method with a printing table and a screen mechanism arranged above it, with a screen frame and a conveying device for moving the printed sheets before, during and after printing.

BACKGROUND OF THE INVENTION

Devices of the type described above have been known in the area of screen printing presses for a long time. They have proved, in principle, successful, but limits are set to the acceleration of the printing process because of the conveying means used. This arises from the fact that the individual printed sheets are grasped by grippers at the beginning of the screen printing press in devices known from the prior art and are then pulled onto the printing table. As soon as the printed sheet to be printed on has reached its correct position on the printing table, the screen frame arranged above the printing table is lowered in order to initiate the printing process. The gripping arms of the conveying means located at the level of the printed sheet must be lowered for this purpose. The gripping arms rise again after the printing operation in order to initiate the next work cycle. Especially the special movements of the gripping arms necessary within the printing mechanism can be accomplished only at an increased mechanical effort and they therefore cause rather substantial additional costs during the manufacture of such screen printing presses.

In addition, it is disadvantageous that the rapidity of the corresponding movements of the gripping arms is limited due to the heavy weights that must be moved.

SUMMARY AND OBJECTS OF THE INVENTION

The object of the present invention is therefore to improve a device for printing printed sheets according to the screen printing method such that the entire printing operation can be speeded up and that the design embodiment especially of the conveying device is substantially simplified and is made less expensive.

This object is accomplished according to the present invention with a device for printing printed sheets according to the screen printing method with a printing table and a screen mechanism arranged above it, with a screen frame and a conveying device for moving the printed sheets before, during and after printing. The conveying device has, when viewed in the conveying direction, at least one clamping device for clamping the lateral edge area of the printed sheets, which is arranged on the side of the printed sheets and is displaceable in the conveying direction. The clamping device has the shape of a continuous chain with individual gripper clamps fastened thereto.

Such a design embodiment avoids the need for additional mechanical movements, such as the lowering of the gripper or the like, so that more rapid conveying of the printed sheets can be achieved, on the whole, within the device. Moreover, there is sufficient space in the lateral area of the printed sheets to guarantee the reliable grasping of the sheets to be conveyed there.

It has proved to be particularly advantageous for the clamping device, which is arranged on the side of the printed sheets and which has at least one gripper clamp with an upper clamping jaw and a lower clamping jaw, to be fastened to an endless conveyor belt running on the side of the printing table. The endless conveyor belt guarantees the continuous movement of the clamping device, so that a return after the conveying of a printed sheet can take place due to the device according to the present invention at a level located below the printing table, the conveyor belt being guided by deflecting rollers. It is thus unnecessary to interrupt the conveying cycles to return the individual clamping devices.

An especially inexpensive design of the conveyor belt is obtained by using a roller chain, wherein the gripper clamps of the clamping device, which are advantageously used in a rather large number, are fastened to an individual chain link each.

Corresponding to an expedient embodiment, the clamping jaws of the gripper clamps are held in the clamping position by spring action, and an actuating cam for releasing the clamping jaws is arranged under the gripper clamps in an unloading area as well as in a feed area for printed sheets; the actuating cam has a length that corresponds to the length of a plurality of chain links arranged one after another with the gripper clamps fastened thereto, so that all the clamping jaws of the gripper clamps involved in the clamping of a printed sheet can be driven simultaneously in a simple manner by a movement of the actuating cam.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 4 is a view of the printing table with the conveying device according to the present invention built in;

DESCRIPTION OF THE PREFERRED EMBODIMENT

Figure 1:
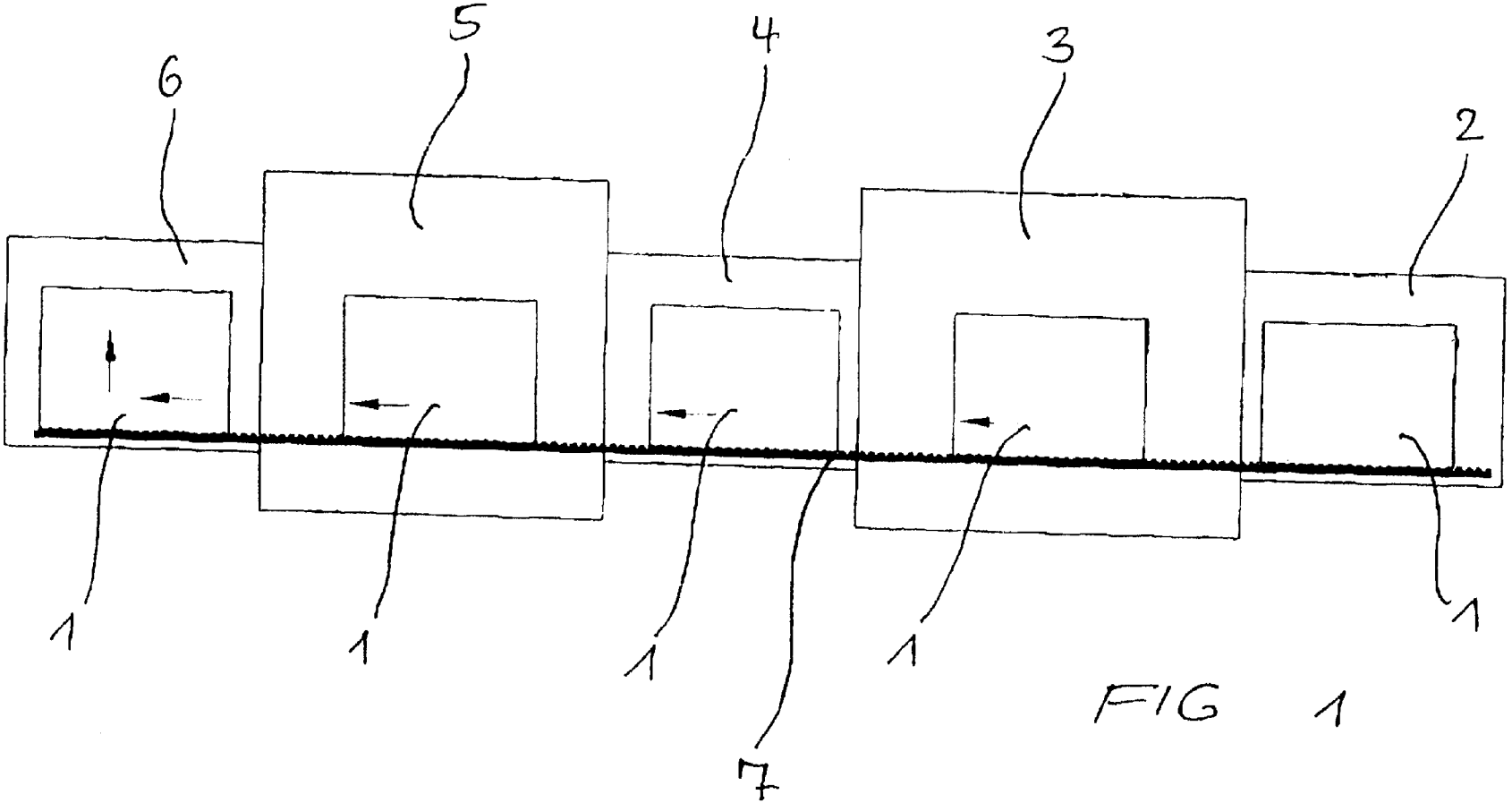
FIG. 1 is a schematic view of a device for printing printed sheets with the various work stations arranged one after another.

Referring to the drawings in particular, a device for printing printed sheets according to the screen printing method usually comprises, as is apparent from FIG. 1, a plurality of work stations arranged one after another. FIG. 1 shows that a printed sheet 1 is located in each of the stations represented by small boxes. The beginning of the entire device forms the sheet feed station 2, in which the printed sheets to be printed on are fed to the press. The sheet feed station 2 is joined by the printing mechanism 3, which is in turn joined by a camera station 4. The camera station 4 is used for quality assurance and it checks the individual printed sheets for satisfactory register marks. The camera station is in turn followed by the drier station 5, in which solvent is extracted from the printing ink printed on the printed sheet, so that the ink will cure, which may also be carried out with UV light. After the individual printed sheet 1 leaves the drier station, the individual printed sheets 1 are delivered.

FIG. 1 also shows that the conveying of the individual printed sheets 1 through the different work stations of the entire device is carried out by means of a conveying device 7 extending on the side of the printed sheets. The conveying device comprises a roller chain, which is provided on the side with gripper clamps fastened to the individual chain links of the roller chain. The specific design of the conveying device 7 appears from FIGS. 2 through 5.

Figure 2:
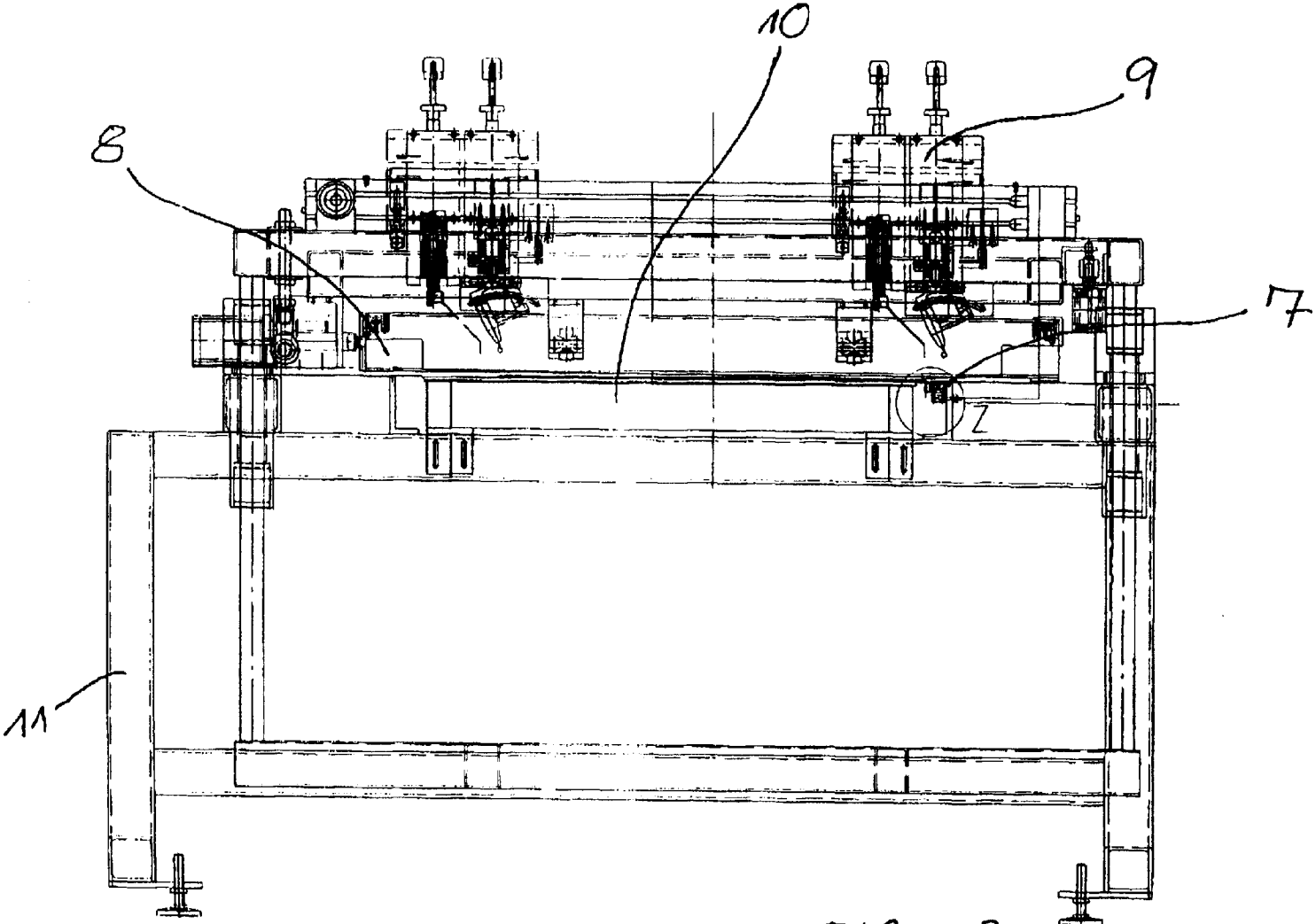
FIG. 2 is a side view of the printing mechanism of a device according to the present invention viewed at right angles to the conveying direction of the printed sheets.

FIG. 2 shows first the printing mechanism 3 in a view at right angles to the conveying direction of the printed sheets. The printing mechanism 3 comprises essentially a printing table 10 as well as a screen frame 8 displaceable upward and downward over the printing table 10 and a screen mechanism 9. The printing table, the screen mechanism and the screen frame are built up on a common frame 11, which consists of a lattice frame. Detail Z within FIG. 2 shows clearly where the conveying device 7 arranged on the side of the printed sheets 1 is located.

Figure 3:
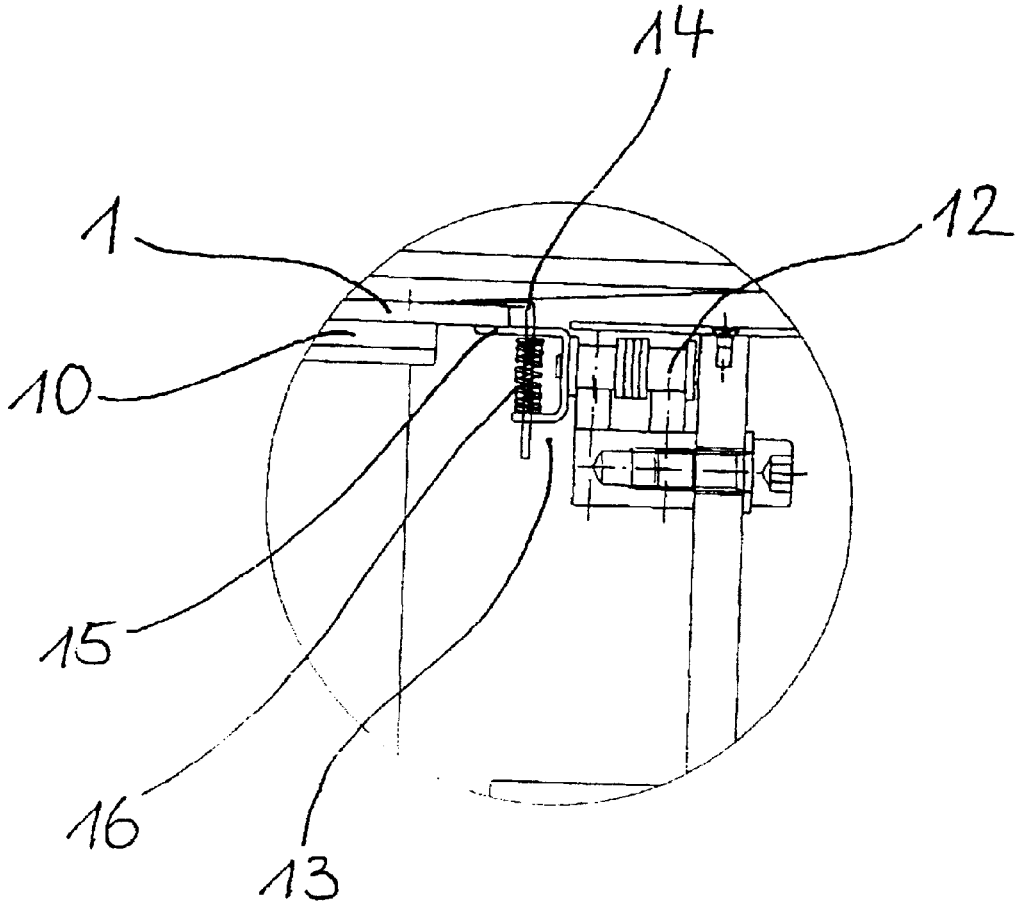
FIG. 3 is an enlarged view of detail Z from FIG. 2.

The enlarged view in FIG. 3 shows that the dimensions of the individual printed sheets are selected to be such that at least the lateral area of a printed sheet 1 projects over the printing table 10 on the side on which the conveying device 7 is located. The conveying device 7 specifically comprises an endless, running roller chain 12, to which a number of gripper clamps 13 are fastened on the side, facing the printing table 10. The gripper clamps 13 are designed such that they have an upper clamping jaw 14 and a lower clamping jaw 15. A compression spring 16, which ensures that both clamping jaws 14 and 15 are held in their clamping position, as shown in FIG. 3, is arranged between the two clamping jaws 14 and 15.

Figure 4:
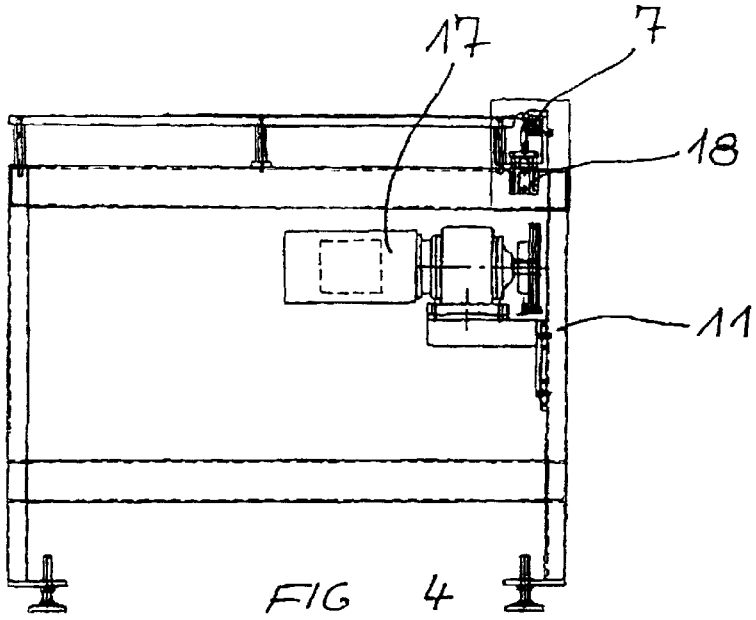

The endless roller chain 12 is driven by an electric motor 17, which is located at the sheet feed station 2 or the sheet unloading station 6 within the frame 11, as is apparent from the view in FIG. 4. The detail V shown in FIG. 4 shows, moreover, that an actuating device 18, which ensures that the clamping of the printed sheets 1 is temporarily eliminated at these stations so that the individual printed sheets can be fed in and removed, is arranged in the sheet feed station or the sheet unloading station.

Figure 5A:
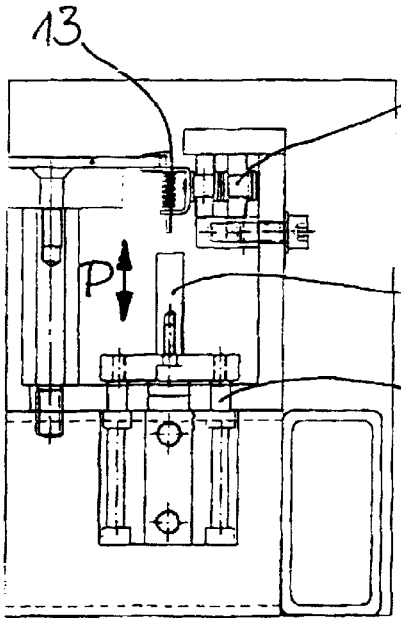
FIG. 5*a* is an enlarged view of detail V of FIG. 4 in the area of the loading and unloading station for the printed sheets.
Figure 5B:
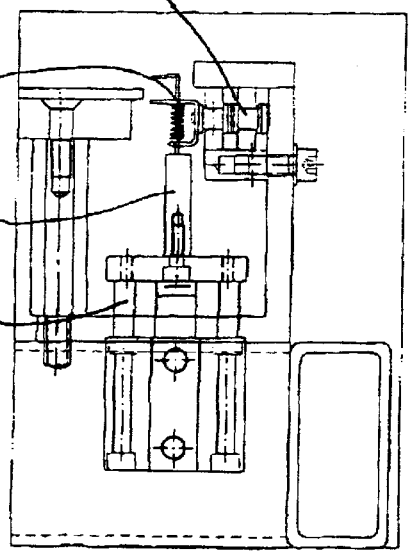
FIG. 5*b* is another enlarged view of detail V in FIG. 4 in the area of the loading and unloading station for the printed sheets.

The enlarged view in FIGS. 5*a* and 5*b* specifically illustrates the actuating procedure of the gripper clamps 13 fastened to the roller chain 12. First, FIG. 5*a* shows the conveying device still in the clamped state. The actuating device 18 comprises essentially an actuating cam 19, which can move up and down electrically or pneumatically in the direction of arrow P. If a printed sheet 1 has been placed in the sheet unloading station 6 or the sheet feed station 2, the actuating cam 19 is moved upward and presses the free end of the upper clamping jaw 14 against the spring action of the compression spring 16. This clamping jaw 14 is raised by the actuating movement of the cam 19 to the extent that the printed sheet 1 between the upper clamping jaws 14 and the lower clamping jaw 15 can be removed or a space can be introduced into the sheet feed station 2. The actuating cam 19 is in such a position now that all the gripper clamps responsible for the clamping of an actuating sheet on the side of the sheet can be actuated simultaneously. After the actuation procedure, the actuating cam 19 returns into its resting position and the compression spring 16 ensures the lowering of the upper clamping jaw 14, so that the clamping action on the printed sheet located between the clamping jaws 14 and 15 is established.

The embodiment of the conveying device as described is a particularly simple and therefore inexpensive design of the conveying device.

While specific embodiments of the invention have been shown and described in detail to illustrate the application of the principles of the invention, it will be understood that the invention may be embodied otherwise without departing from such principles.

What is claimed is:

1. A device for screen printing printed sheets, the device comprising:

a printing table;

a screen printing mechanism arranged above said printing table;

a screen frame, said printing table being disposed below said screen frame in an area of said screen printing mechanism;

a conveying device for moving printed sheets on said printing table and moving said printed sheets before, during and after printing, said conveying device having at least one clamping device for clamping the lateral edge area of a printed sheet, said clamping device being arranged on a side of said printed sheets and being displaceable in a conveying direction.

2. A device in accordance with claim 1, wherein said conveying device includes endless conveyor belt running on the side of said printing table and said clamping device has at least one gripper clamp with a lower clamping jaw and an upper clamping jaw, said gripper clamp being fastened to said endless conveyor belt.

3. A device in accordance with claim 2, wherein said conveyor belt is a roller chain with chain links and said gripper clamp is fastened to one of said chain links.

4. A device in accordance with claim 3, wherein said clamping device further comprises additional gripper clamps, each of said additional gripper clamps being fastened to one of a plurality of chain links arranged next to one another.

5. A device in accordance with claim 4, wherein said clamping device further comprises actuating cams for releasing the clamping jaws, one of said actuating cams being arranged beneath said gripper clamp at an unloading station and one of said actuating cams being arranged beneath said gripper damp at a feed station wherein said clamping jaws of said gripper clamps are held in the clamping position by spring action and said actuating cams each have a length that corresponds to a length of a plurality of chain links arranged one after another with associate gripper clamp fastened thereto.

6. A device in accordance with claim 3, further comprising additional gripper clamps fastened to chain links of said roller chain.

7. A device in accordance with claim 6, further comprising a spring associated with each of said gripper clamps for holding the lower clamping jaw and the upper clamping jaw in a clamping position and an actuating cam for releasing the clamping jaws.

8. A device for screen printing printed sheets, the device comprising:

a printing table;

a screen printing mechanism arranged above said printing table with a screen frame;

a conveying device for moving printed sheets before, during and after printing;

a gripper clamp for clamping the lateral edge area of an individual one of said printed sheets, said gripper clamp being arranged on a side of said printed sheets and being connected to said conveying device and being displaceable in a conveying direction for moving said printed sheets on said printing table and below said screen frame in an area of said screen printing mechanism.

9. A device in accordance with claim 8, wherein said conveying device includes endless conveyor running on the side of said printing table.

10. A device in accordance with claim 9, wherein said gripper clamp has a lower clamping jaw and an upper damping jaw, said gripper clamp being fastened to said endless conveyor adjacent to the side of said printing table.

11. A device in accordance with claim 10, wherein said conveyor is a roller chain with chain links, said gripper clamp being fastened to one of said chain links.

12. A device for screen printing primed sheets, the device comprising:

a printing table having a printing table surface;

a screw printing mechanism arranged above said printing table with a screen frame;

an endless conveying clement extending laterally along a side of said printing table surface;

gripper clamps connected to said endless conveying element for clamping a lateral edge area of an individual one of said printed sheets, winch lateral edge area extends beyond a lateral edge of said printing table, said gripper clamp being arranged on a side of said printed sheets and on a side of said printing table and being connected to said conveying element for displacement of said printed sheets on said printing table surface in a conveying direction for moving said printed sheets on said printing table and below said screen frame in an area of said screen printing mechanism for moving printed sheets before, during and after printing.

13. A device in accordance with claim 12, wherein each of said gripper clamps has a lower clamping jaw and an upper clamping jaw, said gripper clamps being fastened to said endless conveyor element adjacent to the side of said printing table.

14. A device in accordance with claim 13, wherein said conveyor is a roller chain with chain links, each of said gripper clamps being fastened to a respective one of said chain links.

15. A device in accordance with claim 13, further comprising a spring associated with each of said gripper clamps for holding the lower clamping jaw and the upper clamping jaw in a clamping position and an actuating cam for releasing the clamping jaws.

* * * * *